US005886590A

United States Patent [19]

Quan et al.

[11] Patent Number: 5,886,590

[45] Date of Patent: Mar. 23, 1999

[54] MICROSTRIP TO COAX VERTICAL LAUNCHER USING FUZZ BUTTON AND SOLDERLESS INTERCONNECTS

[75] Inventors: Clifton Quan, Arcadia; Steven W. Drost, Sherman Oaks; Mark Y. Hashimoto, Torrance; Rosie M. Jorgenson, Norwalk, all of Calif.

[73] Assignee: Hughes Electronics Corporation, El Segundo, Calif.

[21] Appl. No.: 923,314

[22] Filed: Sep. 4, 1997

[51] Int. Cl.[6] ..... H01P 1/04

[52] U.S. Cl. ..... 333/33; 333/260; 439/581; 439/582

[58] Field of Search ..... 333/33, 246, 260; 439/63, 578, 581, 582

[56] References Cited

U.S. PATENT DOCUMENTS 5,552,752 9/1996 Sturdivant et al. ..... 333/260 X
5,618,205 4/1997 Riddle et al. ..... 333/33 X
5,668,509 9/1997 Hoffmeister et al. ..... 333/33
5,675,302 10/1997 Howard et al. ..... 333/260 X

*Primary Examiner*—Paul Gensler
*Attorney, Agent, or Firm*—Michael W. Sales

[57] ABSTRACT

Coax to microstrip orthogonal launchers that use a compressible fuzz button center conductor as a solderless interconnect. The launcher comprises a coaxial connector having a center conductor that contacts a compressible fuzz button interconnect. In certain embodiments, the fuzz button interconnect directly contacts one end of a microstrip line. In another embodiment, the microstrip line is formed on a curved microstrip circuit board, and the fuzz button interconnect contacts a pin that has a thin metal tab that is adhesively secured to the one end of the microstrip line. In all embodiments, a second coaxial connector has a center conductor that contacts the opposite end of the microstrip conductor line. The present invention eliminates need for precise soldering by using the fuzz button interconnect to create a solderless compression contact between the coaxial connector and the microstrip line. The present invention provides a simple way to vertically launch an RF signal onto microstrip transmission line from a coaxial cable and operates at frequencies up to 18 GHz.

11 Claims, 5 Drawing Sheets

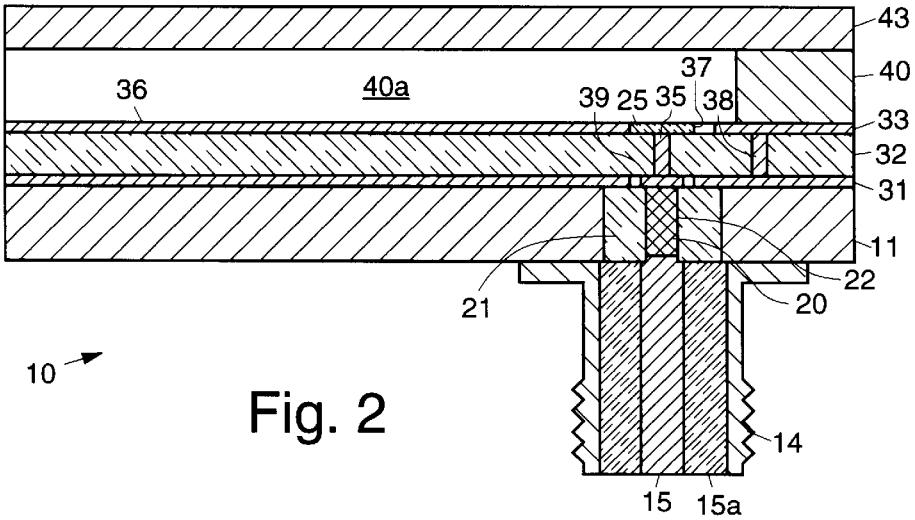
Fig. 2
Fig. 3
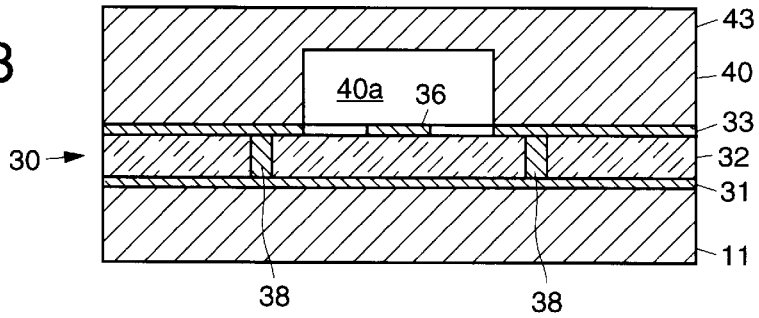
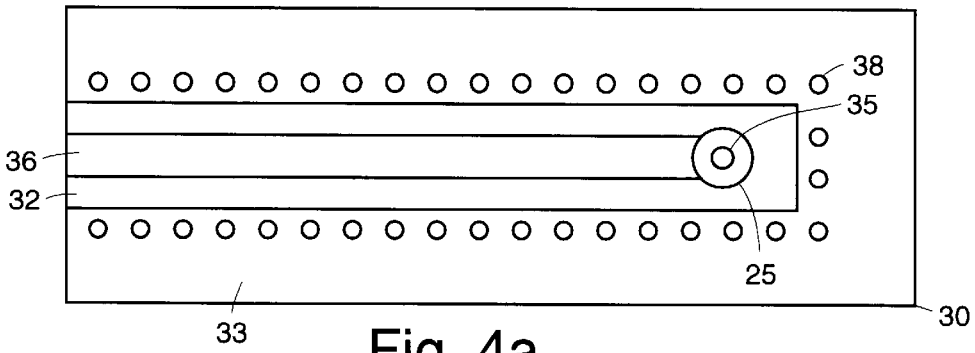
Fig. 4a
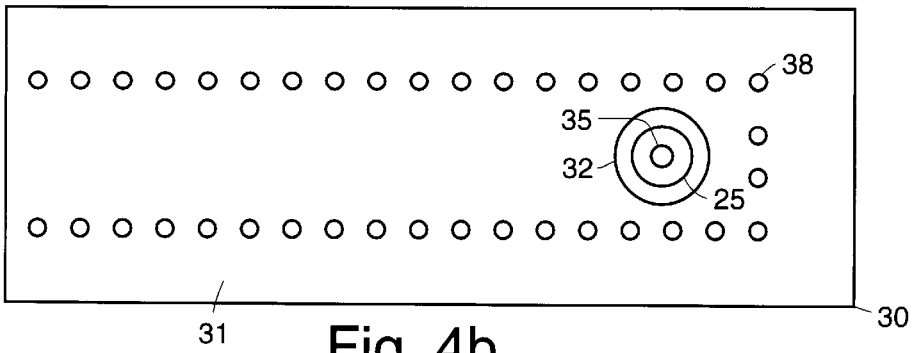
Fig. 4b

MICROSTRIP TO COAX VERTICAL LAUNCHER USING FUZZ BUTTON AND SOLDERLESS INTERCONNECTS

BACKGROUND

The present invention relates generally to coax to microstrip orthogonal launchers, and more particularly, to coax to microstrip orthogonal launchers that use a compressible fuzz button center conductor as a solderless interconnection.

Current active array microstrip corporate feeds require precise soldering of wires onto a microstrip line through a machined hole or trough. For large arrays, the large number of vertical interconnects requiring this precise soldering in the feed requires a large amount of hands-on physical labor. Therefore, it would be an advance in the art to eliminate the requirement for precise soldering and thus lessen the amount of physical labor required to manufacture the array corporate feed.

Also a current state of the art vertical coax to microstrip launcher used by the assignee of the present invention operates up to a frequency of about 12 GHz. It would be an advance in the art to have a vertical coax to microstrip launcher that operates at a higher frequency.

Accordingly, it is an objective of the present invention to provide for coax to microstrip orthogonal launchers that use a compressible fuzz button center conductor as a solderless interconnection. It is a further objective of the present invention to provide for coax to microstrip orthogonal launchers that operate at a frequency substantially higher than conventional orthogonal launchers.

SUMMARY OF THE INVENTION

To accomplish the above and other objectives, the present invention provides for improved coax to microstrip orthogonal launchers that comprise a compressible fuzz button center conductor as a solderless interconnection. In general, the orthogonal coax to microstrip launcher comprises a coaxial connector having a center conductor that contacts a compressible fuzz button interconnect. In certain embodiments, the fuzz button interconnect contacts one end of a microstrip line. In another embodiment, the microstrip line is formed on a curved microstrip circuit board, and the fuzz button interconnect contacts a pin that has a thin metal tab that is adhesively secured to the one end of the microstrip line. In all embodiments, a second coaxial connector has a center conductor connected to the other end of the microstrip conductor line.

The necessity for precise soldering required by conventional coax to microstrip orthogonal launchers is greatly simplified if not eliminated by using the fuzz button interconnect to create a solderless compression contact between the center pin of the coaxial connector and the microstrip line. The present invention provides a simple way to vertically launch an RF signal onto microstrip transmission line from a coaxial cable. The present invention operates at a frequency of up to 18 GHz, which is a wider frequency band than has been achieved in prior art devices. The use of compressible fuzz button interconnects eliminates the need for hard solder connectors required in previous hard wired designs.

The present invention was specifically designed for use on an active array antenna currently under development by the assignee of the present invention to interconnect transmit/receive modules to a first level microstrip feed within a subarray. The present invention may also be used to realize stack microstrip microwave integrated circuit modules for advanced receivers for use in radar and satellite applications, and low cost assemblies for commercial wireless communication equipment.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which:

FIG. 2 is a cross sectional side view of the orthogonal coax to microstrip launcher of FIG. 1;

FIG. 3 is a side view of the launcher of FIG. 2 showing a quasi-channelized 50 ohm microstrip line employed therein;

FIGS. 4*a* and 4*b* show top and bottom views of a circuit board comprising the microstrip line employed in the launcher of FIG. 1;

DETAILED DESCRIPTION

Figure 1:
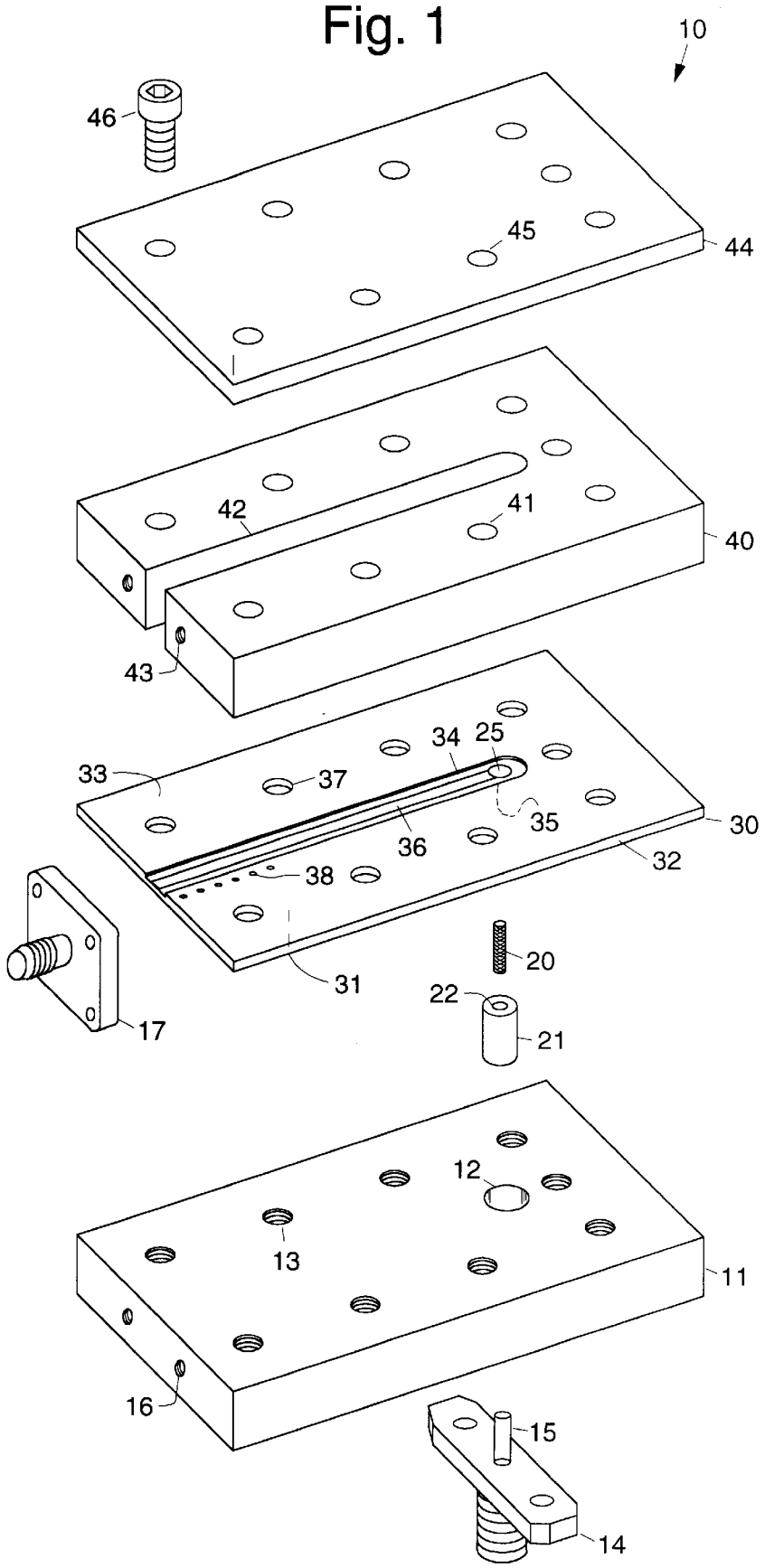
FIG. 1 is an exploded isometric view of a first embodiment of an orthogonal coax to microstrip launcher in accordance with the principles of the present invention.

Referring to the drawing figures, FIG. 1 is an exploded isometric view of a first embodiment of an orthogonal coax to microstrip launcher 10 in accordance with the principles of the present invention, and FIG. 2 is a cross sectional side view of the orthogonal coax to microstrip launcher 10 taken along its centerline. This first embodiment of the launcher injects an RF signal from the bottom of the launcher 10.

The first embodiment of the orthogonal coax to microstrip launcher 10 comprises a lower metal plate 11 that has a hole 12 disposed therethrough and a plurality of threaded holes 13 therein. A coaxial connector 14 having a solid center conductor 15 is secured to the bottom of the lower metal plate 11 such that the center conductor 15 extends into the hole 12. A dielectric sleeve 21, such as a sleeve made of polytetrafluoroethylene 21, for example, having a central opening 22 therethrough is disposed in the hole 12. A compressible fuzz button interconnect 20 is disposed in the central opening 22 and contacts the solid center conductor 15. A plurality of threaded holes 16 are disposed in a lateral sidewall of the lower metal plate 11.

The terms fuzz buttons and fuzz button interconnects should be understood to mean those types of currently practiced in the art, for example, in U.S. Pat. Nos. 5,552,752, 5,146,453, and 5,631,446.

A microstrip circuit board 30 is disposed adjacent to and abuts the lower metal plate 11. The microstrip circuit board 30 is comprised of a lower ground plane 31, a central dielectric layer 32 and an upper ground plane 33. A groove 34 is disposed in the upper ground plane 33 to expose the central dielectric layer 32, and a microstrip line or conductor 36 is formed thereon that extends from a lateral edge of the microstrip circuit board 30 to a plated via 35 that is disposed through the microstrip circuit board 30 and aligns with the fuzz button interconnect 20. A cylindrical portion of the lower ground plane 31 is also removed to provide a conductive pad 39 that contacts the via 35 and the fuzz button interconnect 20. The conductive pad 39 is insulated from the lower ground plane 31 by the gap between them formed by the removed cylindrical portion of the lower ground plane 31. The microstrip circuit board 30 has a plurality of through holes 37 that align with the plurality of threaded holes 13 in the lower metal plate 11. A plurality of plated ground visa 38 are disposed through the central dielectric layer 32 and contact the upper and lower ground planes 31, 33. A capacitive disc 25 is disposed at an internal end of the microstrip line or conductor 36, and contacts the via 35 and the end of the microstrip line or conductor 36.

An upper metal plate 40 is disposed on top of the upper ground plane 33. The upper metal plate 40 has an air channel 42 that extends from the lateral edge of the microstrip circuit board 30 to the location past the via 35. The upper metal plate 40 has a plurality of through holes 41 therethrough that align with the through holes 37 disposed through the microstrip circuit board 30 and the plurality of threaded holes 13 in the lower metal plate 11. A plurality of threaded holes 43 are disposed in a lateral sidewall of the upper metal plate 40 that are substantially the same as the threaded holes 16 in the lower metal plate 11. A second coaxial connector 17 is secured to the threaded holes 16 in the lower metal plate 11 and the threaded holes 43 the upper metal plate 40. A center conductor (not shown) of the second coaxial connector 17 contacts on the microstrip conductor 36.

A cover plate 44 is disposed adjacent to the upper metal plate 40 and has a plurality of through holes 45 that align with the through holes 41 in the upper metal plate 40. A plurality of threaded machine screws 46 are disposed through the through holes 45 in the cover plate 44, the through holes 41 in the upper metal plate 40, the through holes 37 disposed through the microstrip circuit board 30, and thread into the plurality of threaded holes 13 in the lower metal plate 11 to secure the orthogonal coax to microstrip launcher 10 together.

The quasi-channelized 50 ohm microstrip line 36 is connected to a capacitive disc 25 used to match the discontinuity at the orthogonal junctions shown in FIG. 2. In the center of the capacitive disc 25 is a plated via 35 that connects to a metal pad 39 on the opposite side of the circuit board 30. The metal pad 39 is isolated from the microstrip ground plane 31 by an annular clearout area (the gap) whose diameter substantially matches the outer diameter of the coaxial connector 14 within the lower metal plate 11 upon which the circuit board 20 is mounted. The metal pad 39 has a diameter designed to be substantially equal to but preferably slightly greater than the diameter of the fuzz button interconnect 20. The compressible fuzz button interconnect 20 is used as the coax center conductor and contacts the metal pad 39 on the microstrip circuit board 30 at one end while contacting the central conductor 15 of the coaxial connector 14 at the outer end. The diameter of the capacitive disc 25 is adjusted to tune out the discontinuity at the orthogonal microstrip to fuzz button/coax junction.

FIG. 3 is a side view of the launcher 10 of FIG. 2 showing a quasi-channelized 50 ohm microstrip line or conductor 36 employed therein. FIG. 3 details the locations of the microstrip line 36 relative to the cavity 40*a* and the plurality of ground visa 38 that contact the upper and lower ground planes 31, 33.

FIGS. 4*a* and 4*b* show top and bottom views of the microstrip circuit board 30 and its microstrip line 36 employed in the launcher of FIG. 1. The locations of all of the ground visa 38 are shown in FIGS. 4*a* and 4*b*. The via 35 that contacts the fuzz button interconnect 20 is shown. The capacitive disc 25 is shown at an internal end of the microstrip line 36. The capacitive disc 25 is aligned with the conductive pad 39, the via 35, and the fuzz button interconnect 20.

Figure 5:
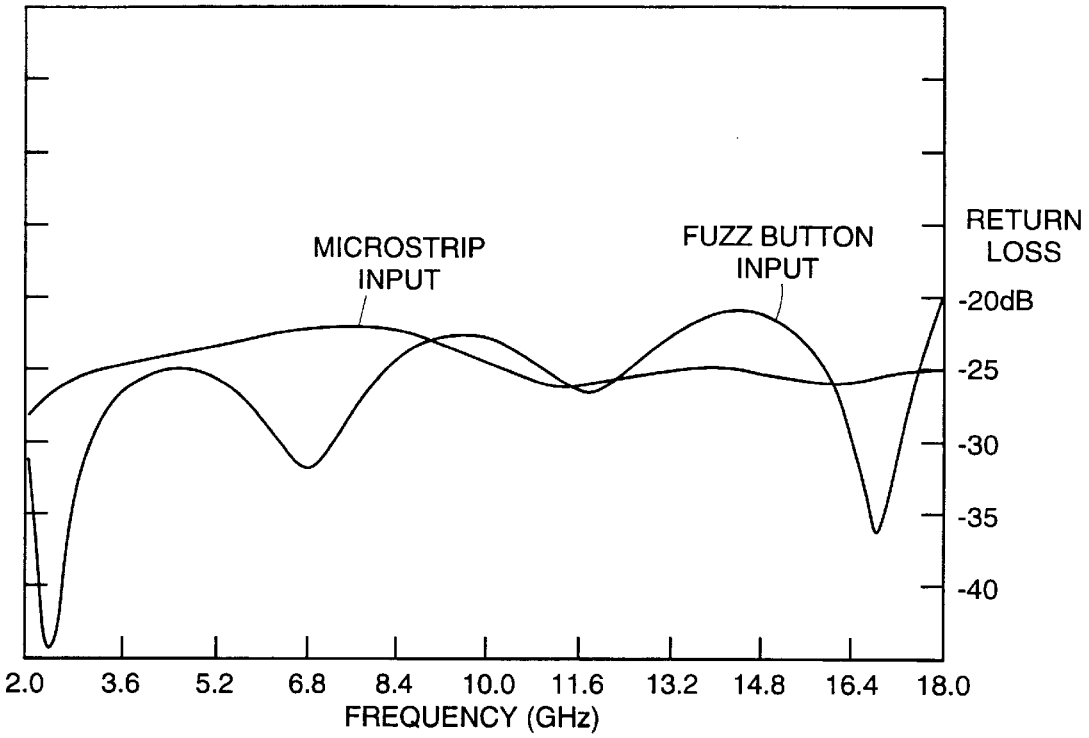
FIG. 5 is a graph showing return loss of a reduced to practice prototype of the first embodiment of the present invention.
Figure 6:
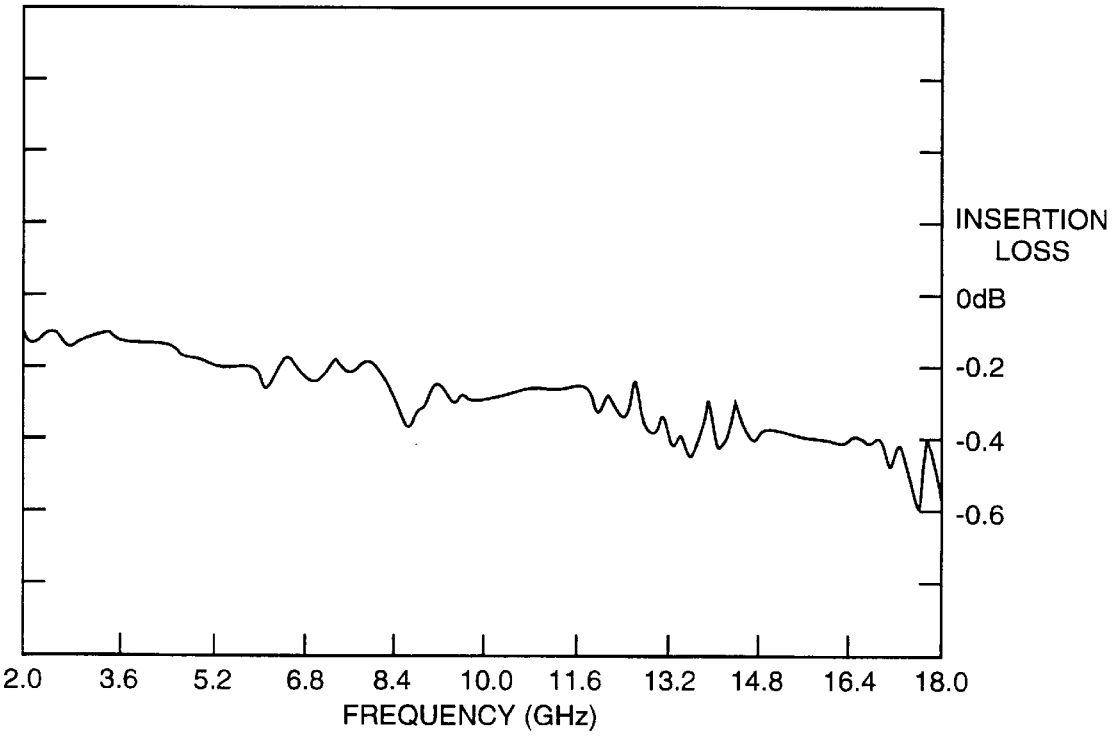
FIG. 6 is a graph showing insertion loss of the reduced to practice prototype of the first embodiment of the present invention.

FIG. 5 is a graph showing return loss of a reduced to practice prototype of the first embodiment of the orthogonal coax to microstrip launcher 10. The RF signal is shown at the input to the microstrip conductor 36 and the input to the fuzz button interconnect 20. FIG. 6 is a graph showing insertion loss of the reduced to practice prototype of the first embodiment of the orthogonal coax to microstrip launcher 10.

Figure 7:
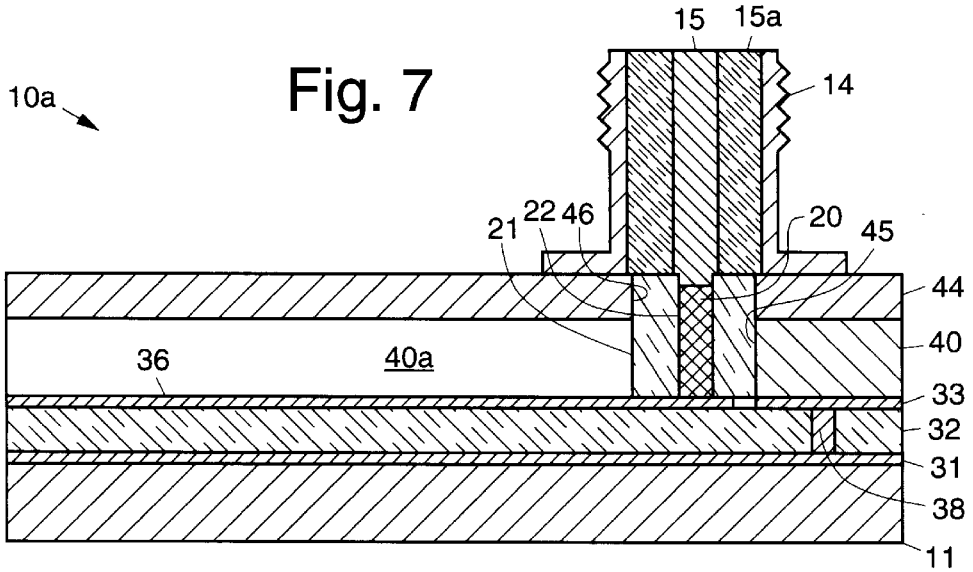
FIG. 7 is a cross sectional side view of a second embodiment of an orthogonal coax to microstrip launcher in accordance with the present invention.

FIG. 7 is a cross sectional side view of a second embodiment of an orthogonal coax to microstrip launcher 1Oa in accordance with the present invention. The second embodiment of the orthogonal coax to microstrip launcher 10*a* is substantially the same as the first embodiment, but the coaxial connector 14 connects to the microstrip conductor 36 from above, through the upper metal plate 43.

The second embodiment of the orthogonal coax to microstrip launcher 10*a* has a solid lower metal plate 11 with a plurality of threaded holes (not shown) disposed therein. The threaded holes in the solid lower metal plate 11 are substantially the same at the threaded holes 13 described with reference to the first embodiment. A microstrip circuit board (not shown) is disposed adjacent to the solid lower metal plate 11. The microstrip circuit board has a lower ground plane 31, a central dielectric layer 32 and an upper ground plane 33. A groove (not shown) is disposed in the upper ground plane 33 to expose the central dielectric layer 32, and a microstrip line or conductor 36 is formed thereon as in the first embodiment. As in the first embodiment, the microstrip circuit board has a plurality of through holes (not shown) that align with the plurality of threaded holes in the lower metal plate 11. A plurality of ground visa 38 are disposed through the central dielectric layer 32 and contact the upper and lower ground planes 31, 33.

An upper metal plate 40 is disposed on top of the upper ground plane 33. The upper metal plate 40 has an air channel that extends from the lateral edge of the microstrip circuit board to the location past the end of the microstrip conductor 36. A through hole 45 is formed at the end of the air channel that is aligned with the end of the microstrip conductor 36. The upper metal plate 40 has a plurality of through holes (not shown) therethrough that align with the through holes disposed through the microstrip circuit board and the plurality of threaded holes in the lower metal plate 11. As in the first embodiment, a plurality of threaded holes (not shown) are disposed in a lateral sidewall of the upper metal plate 40 that match the threaded holes (not shown) in the lower metal plate 11. A second coaxial connector (not shown) is secured to the threaded holes in the lower and upper metal plates 11, 40. A center conductor of the second coaxial connector contacts the microstrip conductor 36. The upper metal plate 40 has a hole 45 therethrough, and a dielectric sleeve 21, such as a sleeve made of polytetrafluoroethylene 21, for example, having a central opening therethrough is disposed in the hole 46. A fuzz button interconnect 20 is disposed in the central opening and contacts the microstrip conductor 36.

A cover plate 44 is disposed adjacent to the upper metal plate 40 and has a plurality of through holes (not shown) that align with the through holes in the upper metal plate 40. A plurality of threaded machine screws (not shown) are disposed through the through holes in the cover plate 44, the through holes in the upper metal plate 40, the through holes disposed through the microstrip circuit board, and thread into the plurality of threaded holes in the lower metal plate 11 to secure the orthogonal coax to microstrip launcher 10 together. The cover plate 44 has a hole 46 therein that is aligned with the hole 45 in the upper metal plate 40. A coaxial connector 14 having a solid center conductor 15 is secured to the top of the upper metal plate 40 such that the center conductor 15 extends into the hole 46 and contacts the fuzz button interconnect 20 disposed in the dielectric sleeve 21.

As in the first embodiment, a plurality of threaded holes (not shown) are disposed in a lateral sidewall of the lower metal plate 11, and a plurality of threaded holes (not shown) are disposed in a lateral sidewall of the upper metal plate 40 that are substantially the same as the threaded holes 16 in the lower metal plate 11. A second coaxial connector (not shown) is secured to the threaded holes in the lower metal plate 11 and the threaded holes the upper metal plate 40 as in the first embodiment. A center conductor (not shown) of the second coaxial connector contacts on the microstrip conductor 36.

In the second embodiment of the present invention, the fuzz button interconnect 20 is used to vertically launch an RF signal from the coaxial connector 14 above the circuit board onto the microstrip line 36. This technique uses a direct fuzz button interconnect 20 to make contact between the microstrip line 36 and the central conductor 15 of the coaxial connector 14. An opening in the outer shield of the coaxial connector 14 is provided to prevent short-circuiting of the microstrip line 36 and to match the discontinuity at the orthogonal junction. By using the fuzz button interconnect 20, a blind solderless vertical coaxial to microstrip transition through an air cavity 40*a* onto the circuit board is realized.

Figure 8:
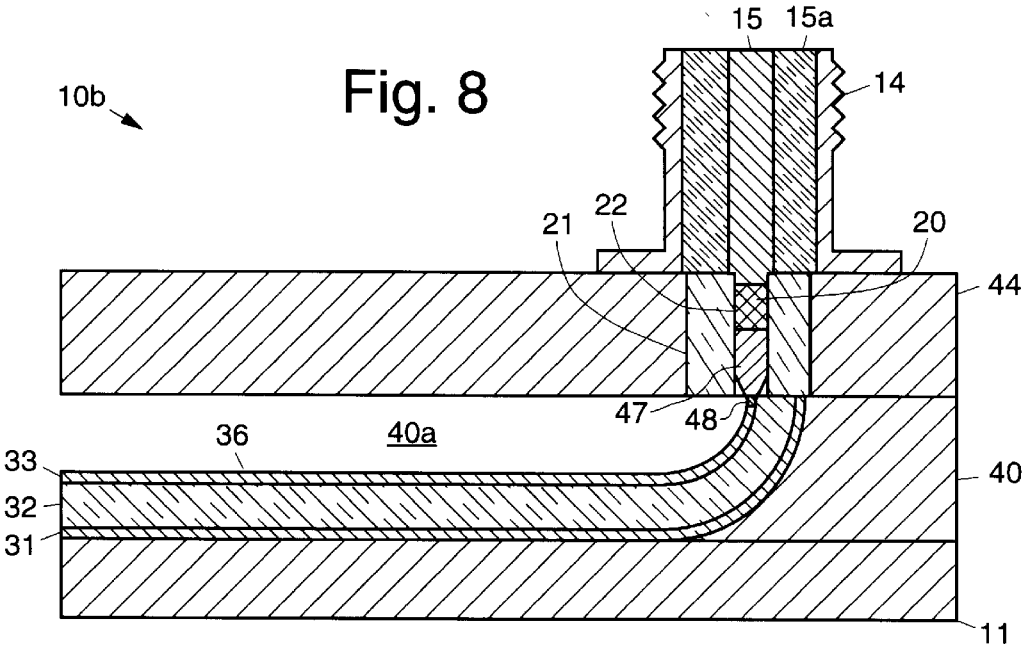
FIG. 8 is a cross sectional side view of a third embodiment of an orthogonal coax to microstrip launcher in accordance with the present invention.

FIG. 8 is a cross sectional side view of a third embodiment of an orthogonal coax to microstrip launcher 10*b* in accordance with the present invention. The third embodiment of an orthogonal coax to microstrip launcher 10*b* is similar to the embodiment shown in FIG. 7. However, the third embodiment uses a microstrip circuit board having a 90 degree radial bend therein. As is shown in FIG. 8, the central dielectric layer 32, the upper ground plane 33 and the lower ground plane 31 are radiused so that the upper ground plane 33 ends adjacent to the location of the hole in the dielectric sleeve 21.

A center pin 47 having a thin metal tab 48 at its end is disposed in the hole in the dielectric sleeve 21 and is used in cooperation with a fuzz button interconnect 20 that is disposed behind the center pin 47. The metal tab 48 at the end of the tapered portion of the coaxial center pin 47 is electrically connected to the microstrip conductor 36 using an adhesive, such as an epoxy adhesive, for example. The upper metal plate 40 is radiused to accept the radially bent microstrip circuit board as is shown in FIG. 8.

The third embodiment of the orthogonal coax to microstrip launcher 10*b* shown in FIG. 8 is an alternative approach to vertically launch an RF signal onto a microstrip line 36 from above the circuit board which involves shaping the circuit board to form a 90 degree radial bend. The coaxial center pin 47 has its thin metal tab 48 adhesively secured with epoxy to the microstrip line 36 prior to installing the fuzz button interconnect 20. The performance of the vertical transition provided by the third embodiment of the orthogonal coax to microstrip launcher 10*b* operates to a frequency of about 18 GHz. A prototype of the third embodiment of the orthogonal coax to microstrip launcher 10*b* was fabricated and tested, and was found to perform properly.

Figure 9:
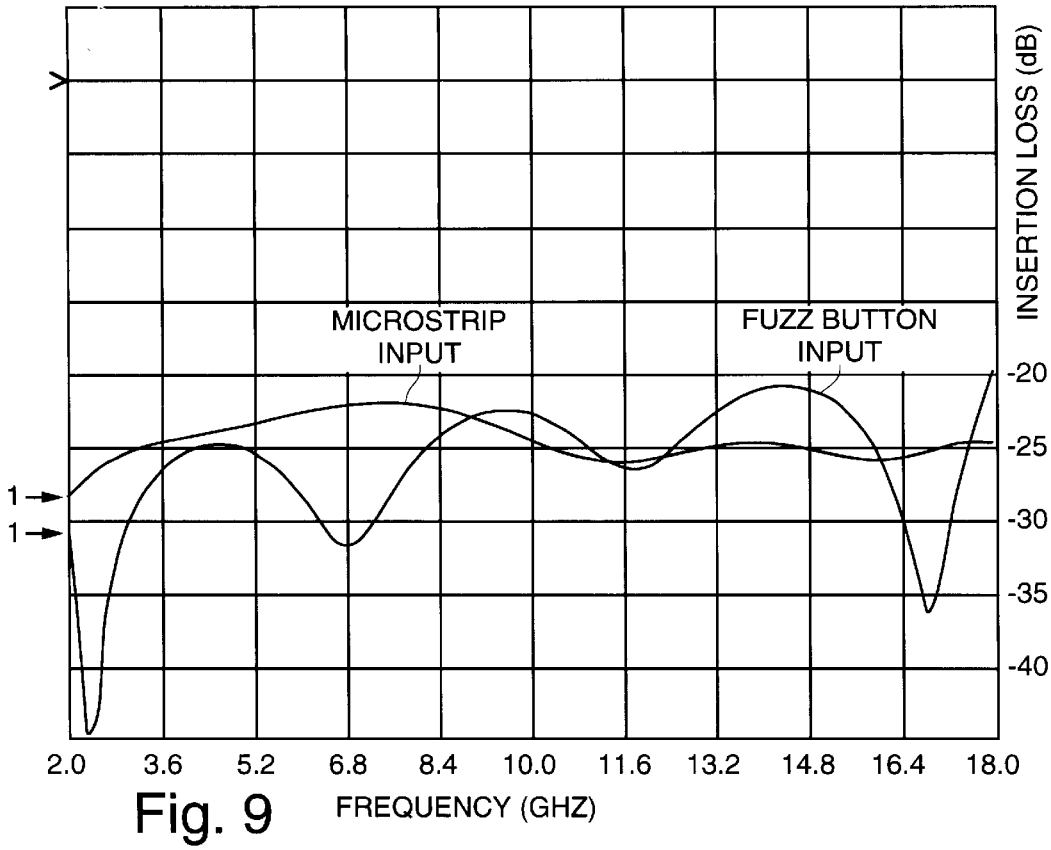
FIG. 9 is a graph showing return loss of a reduced to practice prototype of the third embodiment of the present invention.
Figure 10:
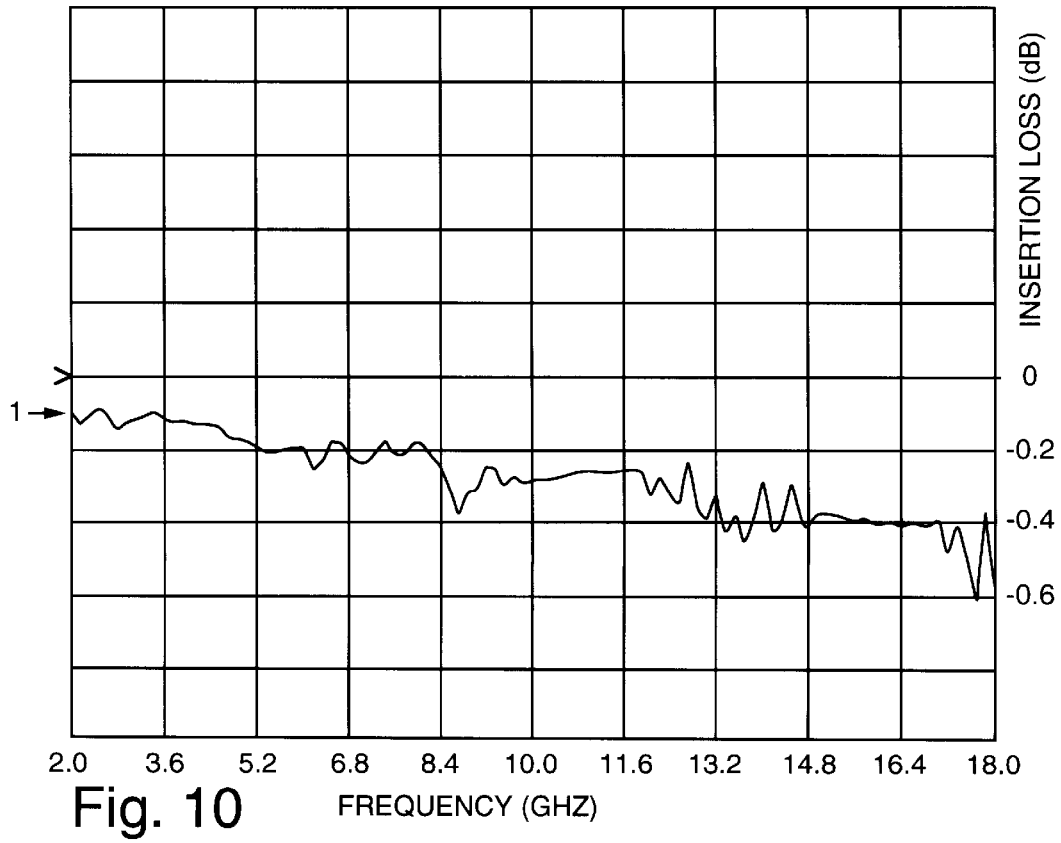
FIG. 10 is a graph showing insertion loss of the third embodiment of the of the third embodiment of the present invention.

FIG. 9 is a graph showing return loss of a reduced to practice prototype of the third embodiment of the coax to microstrip launcher. FIG. 10 is a graph showing Insertion loss of a reduced to practice prototype of the third embodiment of the coax to microstrip launcher.

Thus, coaxial to microstrip orthogonal launchers that use a compressible fuzz button center conductor as a solderless interconnection have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An orthogonal coax to microstrip launcher comprising:

a lower metal plate having a hole disposed therethrough;

a coaxial connector having a center conductor that extends into the hole in the lower metal plate;

a dielectric sleeve having a central opening therethrough disposed in the hole in the lower metal plate;

a compressible fuzz button interconnect disposed in the central opening of the dielectric sleeve that contacts the center conductor of the coaxial connector;

a microstrip circuit board disposed adjacent to the lower metal plate that comprises a lower ground plane, a central dielectric layer, an upper ground plane having a microstrip conductor formed thereon that extends from a lateral edge of the microstrip circuit board to a plated via disposed through the microstrip circuit board said via connecting to a conductive pad insulated from the lower ground plane and aligned with the fuzz button interconnect, a plurality of plated ground visa disposed through the central dielectric layer that contact the upper and lower ground planes, and a capacitive disc that contacts the via and the end of the microstrip conductor;

an upper metal plate disposed on the upper ground plane having an air channel that is substantially coextensive with the microstrip conductor;

a second coaxial connector having a center conductor that contacts the microstrip conductor; and a cover plate disposed adjacent to the upper metal plate.

2. The orthogonal coax to microstrip launcher of claim 1 wherein the dielectric sleeve comprises a sleeve made of polytetrafluoroethylene.

3. The orthogonal coax to microstrip launcher of claim 1 wherein the capacitive disc is used to match the discontinuity at the orthogonal junction between the microstrip line and the coaxial connector.

4. The orthogonal coax to microstrip launcher of claim 1 wherein the diameter of the capacitive disc is adjusted to tune out the discontinuity at the junction orthogonal between the microstrip conductor and the fuzz button interconnect and center conductor of the coaxial connector.

5. The orthogonal coax to microstrip launcher of claim 1 wherein the fuzz button interconnect comprises a blind solderless vertical coaxial to microstrip transition.

6. An orthogonal coax to microstrip launcher comprising:

a lower metal plate;

a microstrip circuit board disposed adjacent to the lower metal plate that comprises a lower ground plane, a central dielectric layer, an upper ground plane having a microstrip conductor formed thereon, and a plurality of ground visa disposed through the central dielectric layer that contact the upper and lower ground planes;

an upper metal plate disposed on the upper ground plane comprising an air channel that is substantially coextensive with the microstrip conductor, and a through hole that is aligned with the inner end of the microstrip conductor, and a dielectric sleeve having a central opening disposed in the through hole;

a fuzz button interconnect disposed in the central opening that contacts the microstrip conductor;

a cover plate disposed adjacent to the upper metal plate having a hole therein that aligns with the hole in the upper metal plate;

a coaxial connector having a solid center conductor that extends into the hole and contacts the fuzz button interconnect disposed in the dielectric sleeve; and a second coaxial connector disposed at the end of the microstrip conductor having a center conductor that contacts the microstrip conductor.

7. The orthogonal coax to microstrip launcher of claim 5 wherein the dielectric sleeve comprises a sleeve made of polytetrafluoroethylene.

8. The orthogonal coax to microstrip launcher of claim 5 wherein the fuzz button interconnect comprises a blind solderless vertical coaxial to microstrip transition through an air cavity onto the microstrip conductor.

9. An orthogonal coax to microstrip launcher comprising:

a lower metal plate;

a curved microstrip circuit board disposed adjacent to the lower metal plate that comprises a lower ground plane, a central dielectric layer, and an upper ground plane having a microstrip conductor formed thereon;

an upper metal plate having an internal contour that matches the contour of the curved microstrip circuit board, and that comprises an air channel that is substantially coextensive with the microstrip conductor, and having a through hole that is aligned with the inner end of the microstrip conductor;

a cover plate disposed adjacent to the upper metal plate having a hole therein that aligns with the hole in the upper metal plate;

a dielectric sleeve having a central opening disposed in the hole in the upper metal plate and in the through hole of the upper metal plate;

a center pin having a thin metal tab at its end disposed in the hole in the dielectric sleeve that is electrically connected to the microstrip conductor;

a fuzz button interconnect disposed in the hole in the dielectric sleeve that contacts the center pin;

a coaxial connector having a center conductor that extends into the hole in the cover plate and contacts the fuzz button interconnect disposed in the dielectric sleeve; and a second coaxial connector disposed at the end of the microstrip conductor having a center conductor that contacts the microstrip conductor.

10. The orthogonal coax to microstrip launcher of claim 8 wherein the dielectric sleeve comprises a sleeve made of polytetrafluoroethylene.

11. The orthogonal coax to microstrip launcher of claim 8 wherein the fuzz button interconnect comprises a blind solderless vertical coaxial to microstrip transition through an air cavity onto the microstrip conductor.

* * * * *